US006631745B2

(12) United States Patent
Fontenot et al.

(10) Patent No.: US 6,631,745 B2
(45) Date of Patent: Oct. 14, 2003

(54) RISER PULL-IN METHOD AND APPARATUS

(75) Inventors: William L. Fontenot, Houston, TX (US); Charles L. Garnero, Cypress, TX (US); Brent A. Salyer, Cypress, TX (US); Stephen P. Lindblade, Waller, TX (US); L. Terry Boatman, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/188,609

(22) Filed: Jul. 2, 2002

(65) Prior Publication Data

US 2003/0000447 A1 Jan. 2, 2003

Related U.S. Application Data

(60) Provisional application No. 60/302,456, filed on Jul. 2, 2001.

(51) Int. Cl.[7] ..... B67C 3/26; B67C 3/34

(52) U.S. Cl. ..... 141/279; 141/387; 441/4; 114/230.13; 114/230.26

(58) Field of Search ..... 141/279, 311 R, 141/382, 383, 387, 392; 441/3–5; 114/230.1, 293, 230.13, 230.2, 230.26

(56) References Cited

U.S. PATENT DOCUMENTS 4,281,614 A * 8/1981 McNary et al. ..... 114/264
5,372,531 A * 12/1994 Boatman et al. ..... 441/4

* cited by examiner

*Primary Examiner*—Timothy L. Maust
(74) *Attorney, Agent, or Firm*—Gary L. Bush, Esq.; Andrews & Kurth, LLP

(57) ABSTRACT

An arrangement and pull-in method for fluidly coupling a steel riser to a flowline of a turret on a FSO/FPSO. The riser is pulled into a connector by a pull-in line inside the flowline. A pull-in head is releasable secured inside the upper end of the riser. The pull-in head is released from the riser after the riser is locked into the connector. A flex joint is placed above the connector to provide alignment of the connector to the riser during installation.

10 Claims, 9 Drawing Sheets

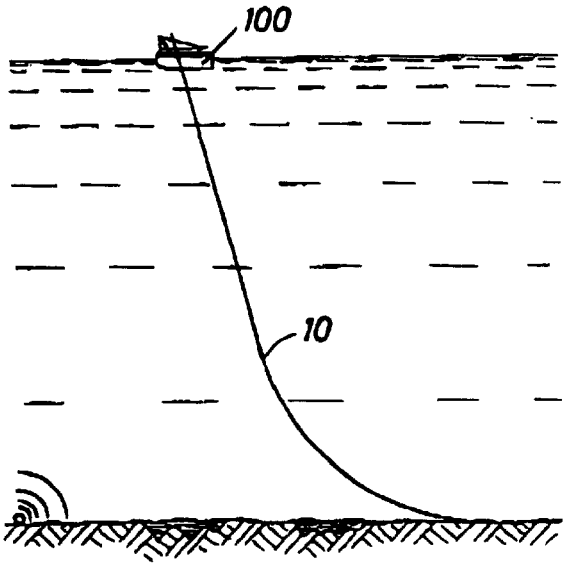
FIG. 8
FIG. 9
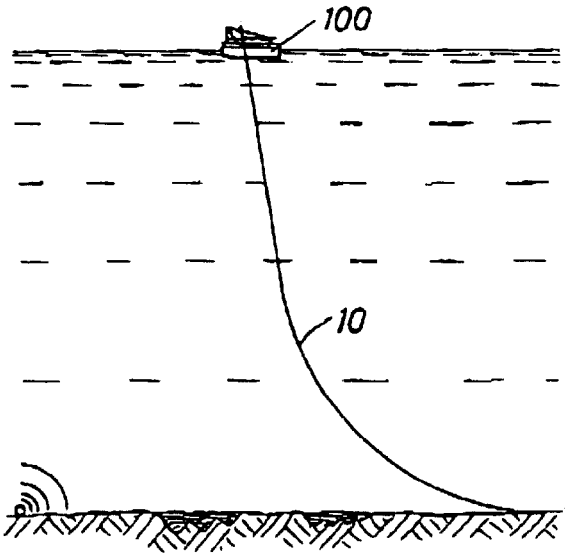
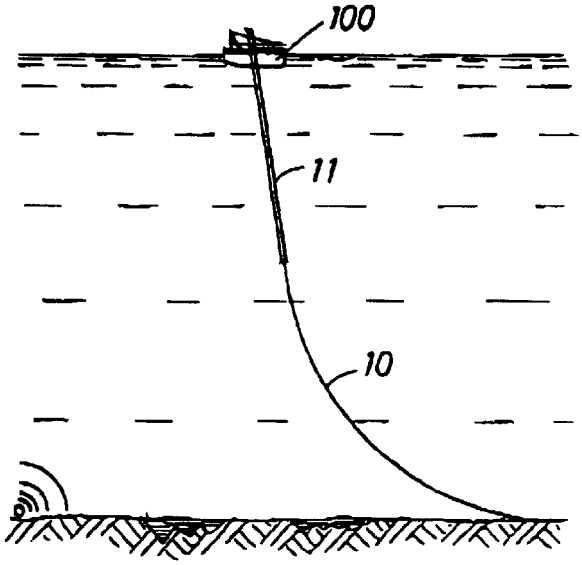
FIG. 10
FIG. 11
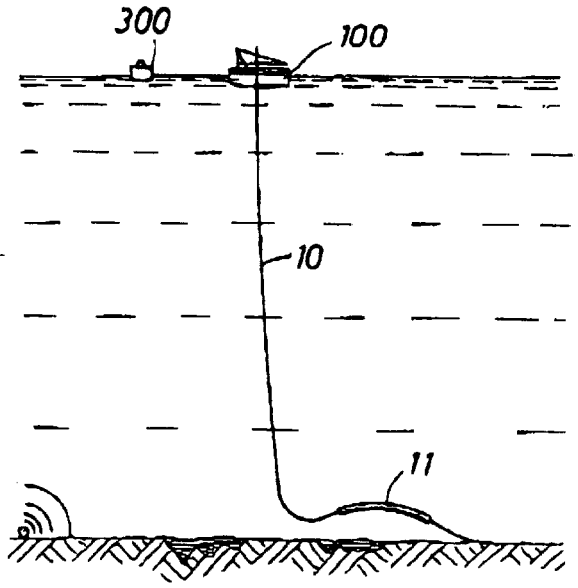

FIG. 12
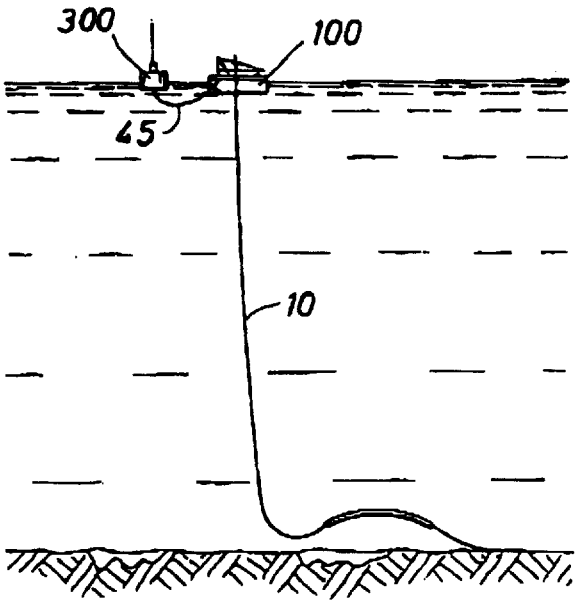
FIG. 13
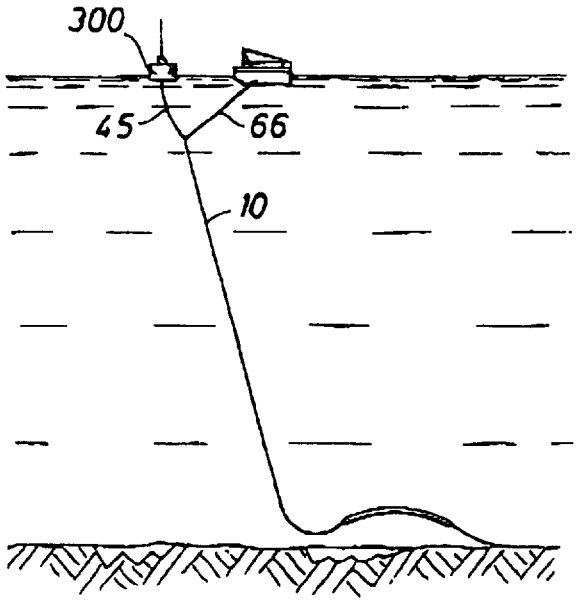
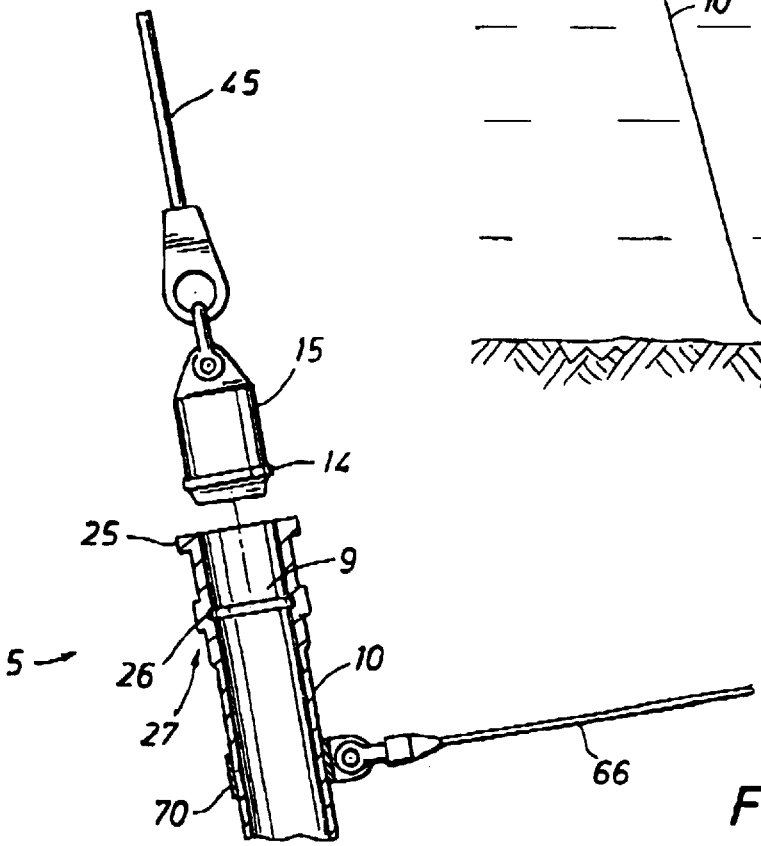
FIG. 13A

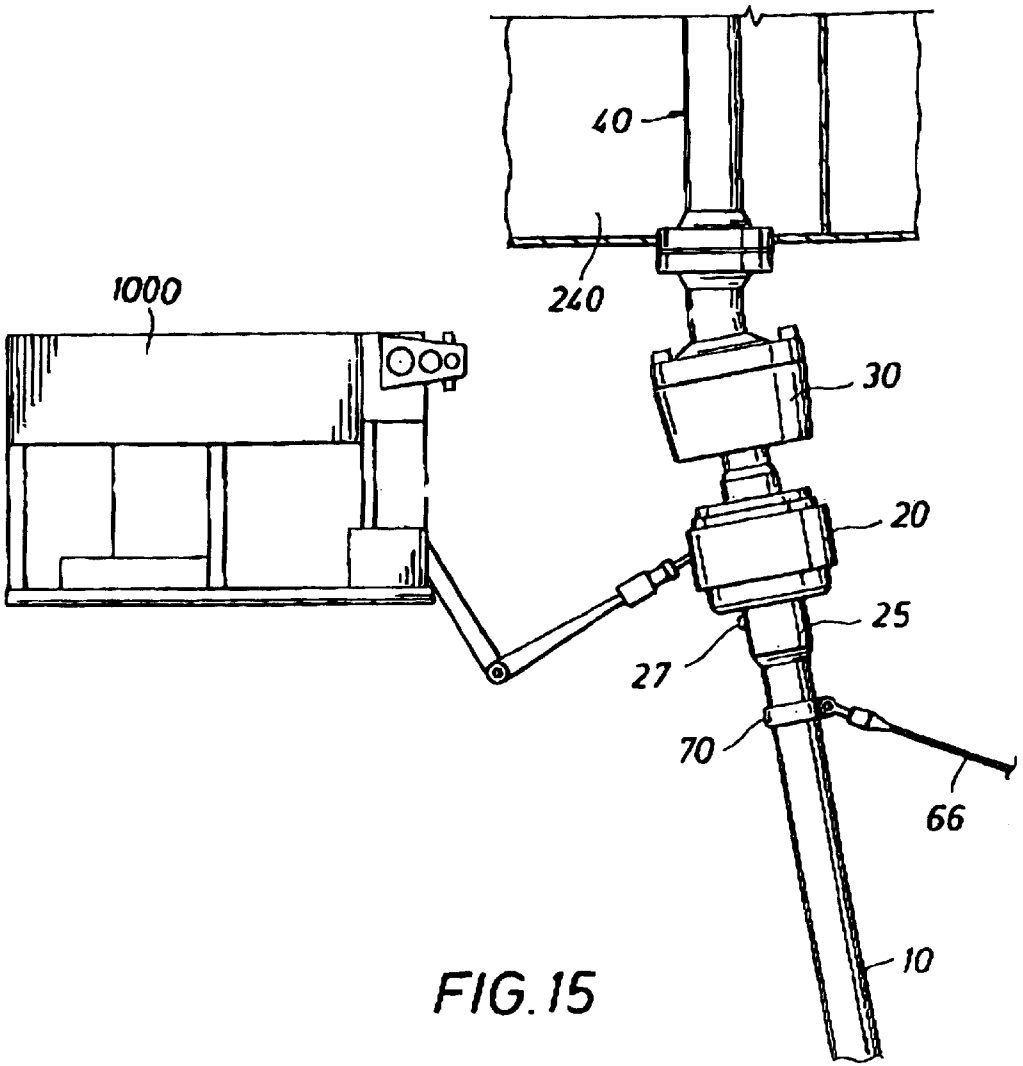
FIG. 15
FIG. 14
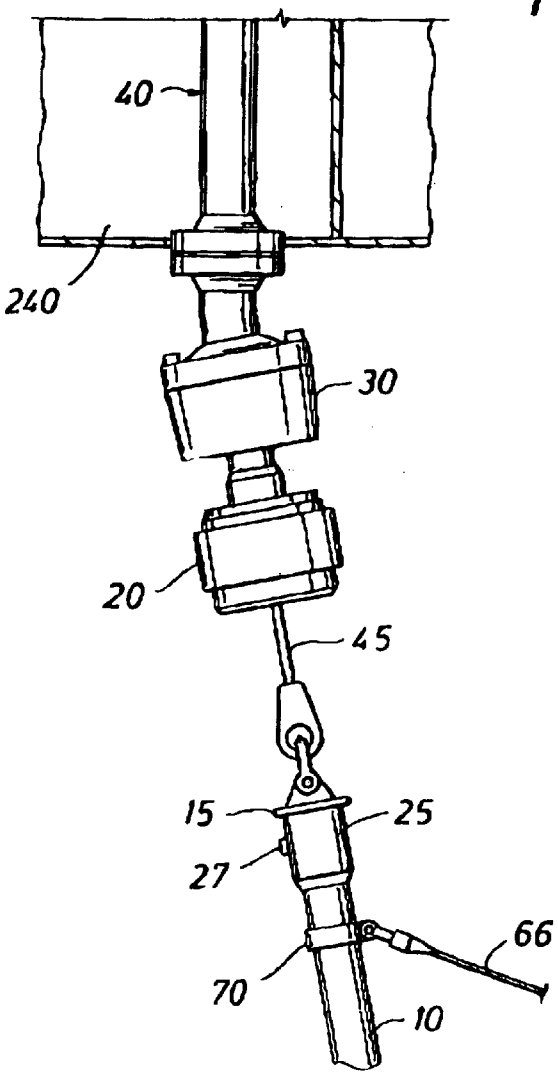

FIG. 16
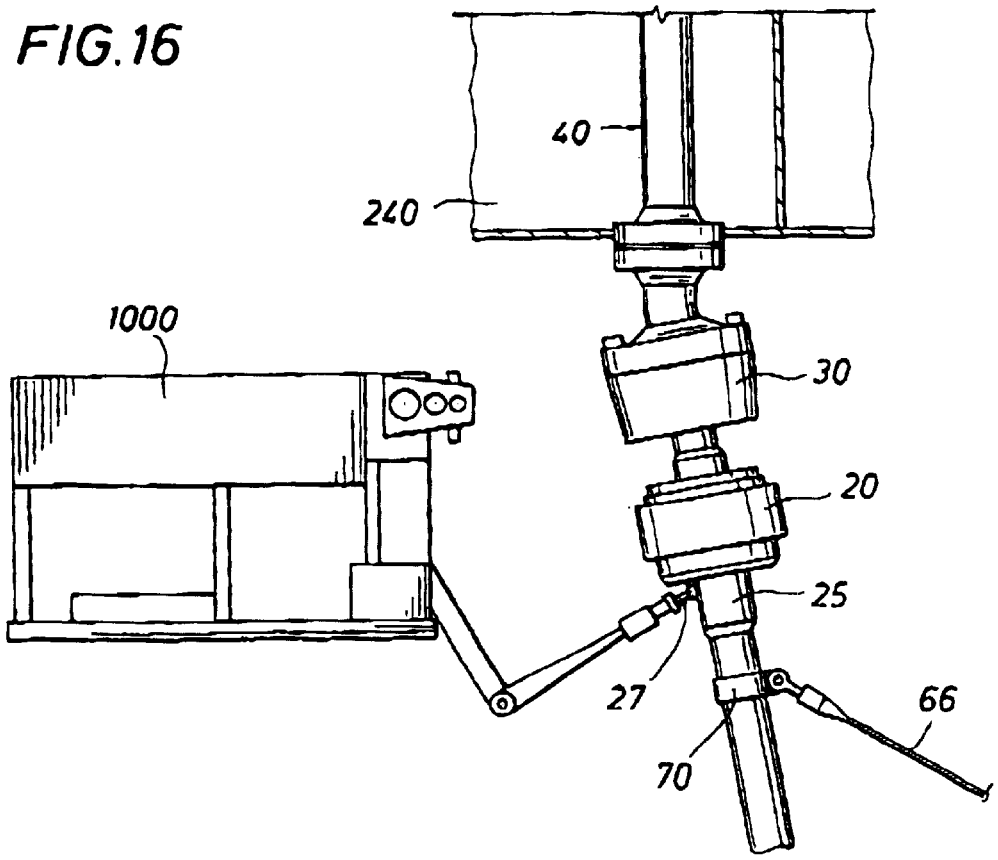
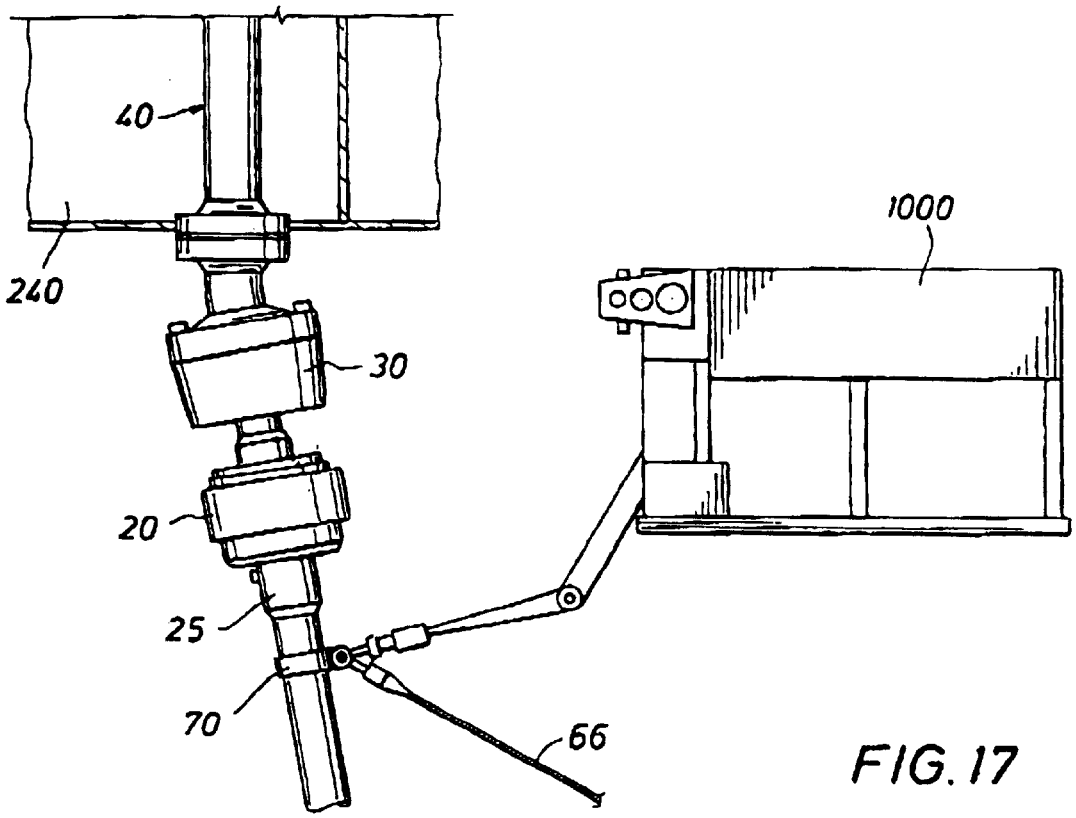
FIG. 17

RISER PULL-IN METHOD AND APPARATUS

RELATED APPLICATION

This application claims the benefit of U.S. Provisional Patent Application Ser. No. 60/302,456, filed Jul. 2, 2001.

BACKGROUND OF THE INVENTION

1. Field of the Invention

This invention relates generally to mooring systems for offshore floating terminals. In particular, the invention relates to an apparatus and method by which a steel catenary riser is connected to a turret of a floating storage and/or production vessel while simultaneously fluidly coupling the riser to a flowline in the turret.

2. Description of the Prior Art

Flexible riser hang-off systems have been proposed for hanging off Steel Catenary Risers (SCRs) from offshore terminals. FIG. 1 of the attached drawings shows a typical prior art receptacle/flexjoint assembly 10 for an SCR 12 where a "flexjoint" (a proprietary product of Oil States Industries Inc.) assembly 11 is hung off the side 14 of a production platform by a receptacle frame 13. A sealed fluid coupling between riser 12 and a platform flowline 7 is accomplished. Other prior art riser hang-off assemblies 10A, 10B, 10C with pull-in hardware 16 are illustrated in FIGS. 2 through 4. FIG. 2 shows a prior art hang-off arrangement known as a LYNX™ system. An I-tube 60 is mounted in an opening of a mono-buoy structure 150. A pull in head 16 is secured to a frustro-conical shaped connecter 8 and flex joint 11A secured to the top of the riser 12. A sealed connection is made at I-tube seal 9, when the riser is pulled up into the I-tube 60.

FIG. 3 shows another prior art hang-off arrangement where a riser 12 is pulled alongside a platform 14 for sealed fluid connection to a platform flowline. The arrangement of FIG. 3, known as an Alligator Rigid Riser Pull-on System, also includes a flex joint assembly 11A, a pull-in head 16 and coupling devices for sealingly coupling riser 12 to a platform flow line.

FIG. 4 shows a prior art hang-off system known as a hydraulic rigid riser pull-in system, also having a flex-joint assembly 11B, a pull-in head 16 and an arrangement for providing a sealed connection between the riser 12 and flow lines of the structure.

While flexible riser hang-off systems such as 10, 10A, 10B and 10C have been proposed for production platforms, a problem remains for pulling in and connecting SCRs to flowlines of a turret of an offshore terminal such as a Floating Storage and Offloading vessel (FSO) or Floating Production Storage and Offloading vessel (FPSO). The problem concerns connection of the Steel Catenary Riser to the flowline within the mooring turret without costly and dangerous intervention by deep sea divers.

3. Identification of Objects of the Invention

A primary object of the invention is to provide a method and apparatus for connecting a SCR to a flowline within a turret of a FSO/FPSO that will minimize intervention by divers.

SUMMARY OF THE INVENTION

The object identified above, along with other features and advantages of the invention, is embodied in an arrangement with a flexjoint and a hydraulic connector hung from the bottom end of the turret and fluidly coupled to production piping (e.g., a flowline) within the turret. A pull-in line run through the production piping, flexjoint and hydraulic connector, includes a riser pull-in head which latches to a riser connector hub installed in the upper end of the riser. In operation, the pull-in line pulls the riser (SCR) to the hydraulic connector for operational securement to the end of the turret flowline.

BRIEF DESCRIPTION OF THE DRAWINGS

The invention is described by reference to attached drawings of which:

FIGS. 8–13, and 13A–17 illustrate a method according to the invention for pulling in the riser and for connection of the riser to a flowline in the turret of the vessel.

DESCRIPTION OF THE INVENTION

Figure 2:
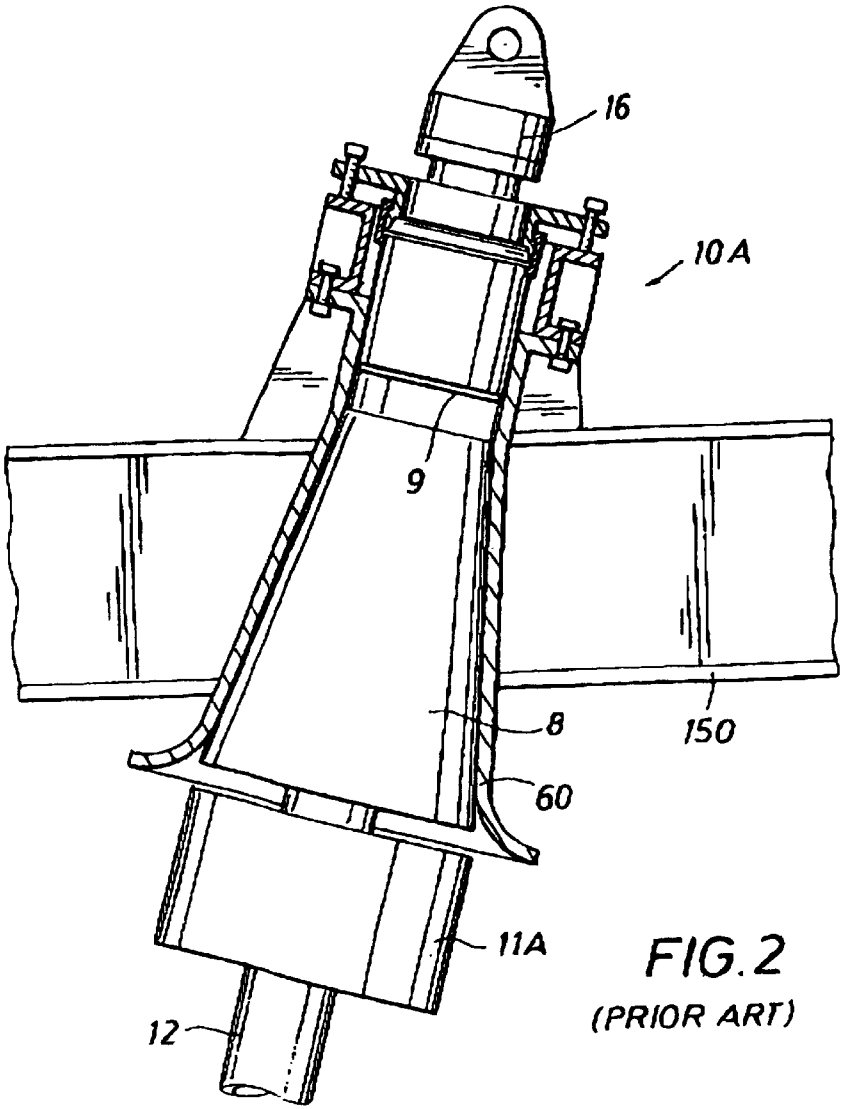
FIG. 2 (PRIOR ART)
FIGS. 1–4 illustrate prior art receptacle/flexjoint interfaces for a Steel Catenary Riser used with offshore production platforms.
Figure 1:
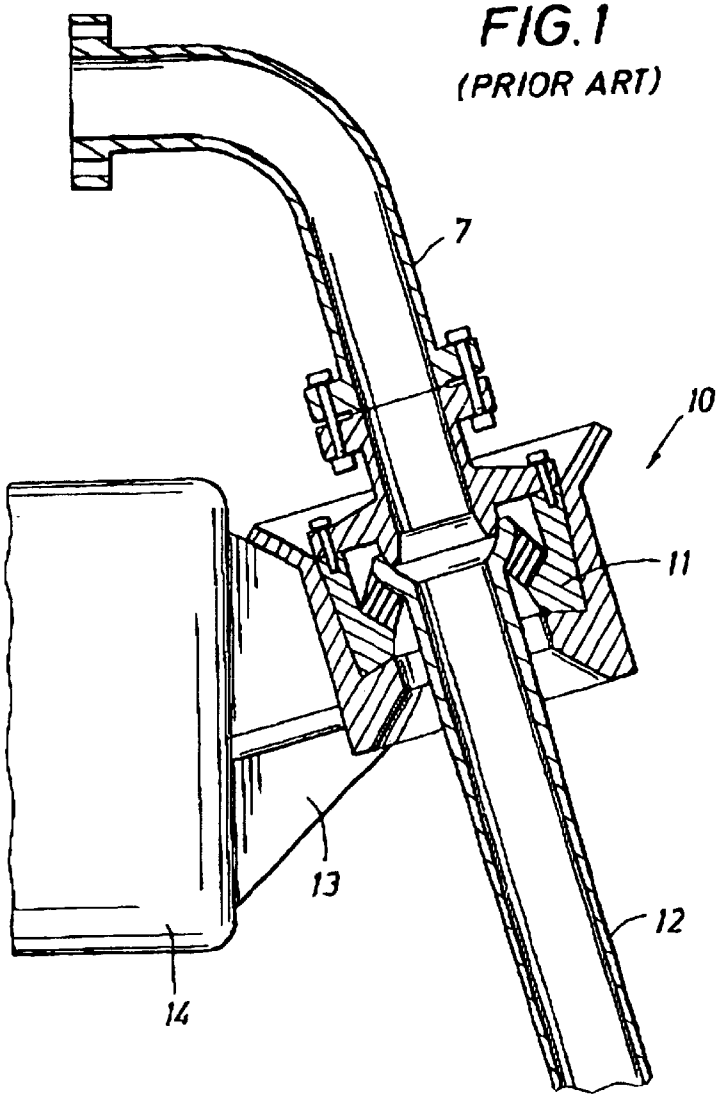
FIG. 1 (PRIOR ART)
Figure 4:
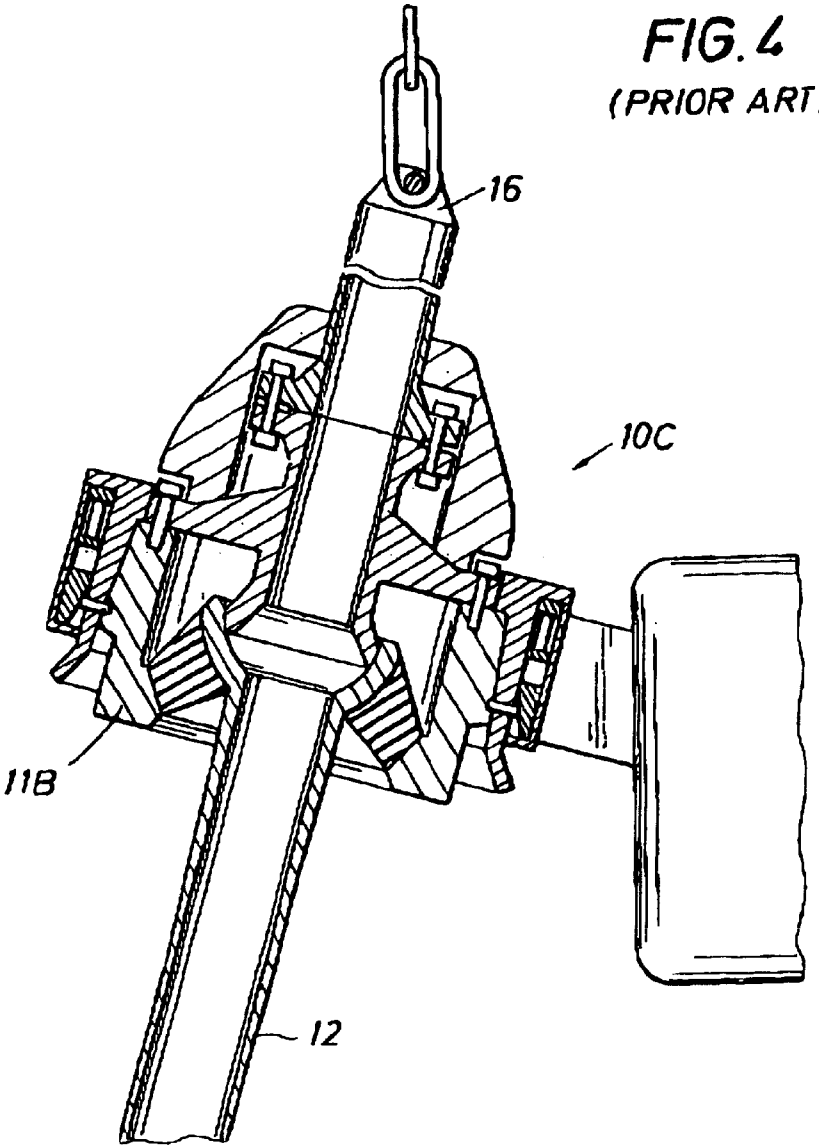
FIG. 4 (PRIOR ART)
Figure 3:
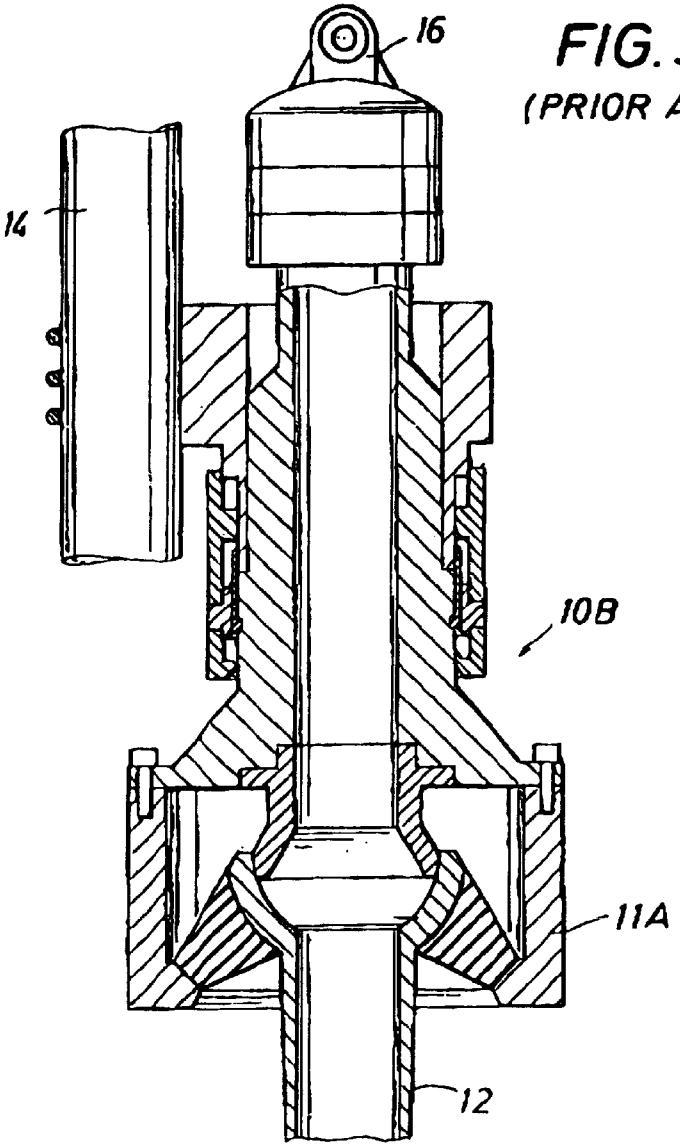
FIG. 3 (PRIOR ART)
Figure 5:
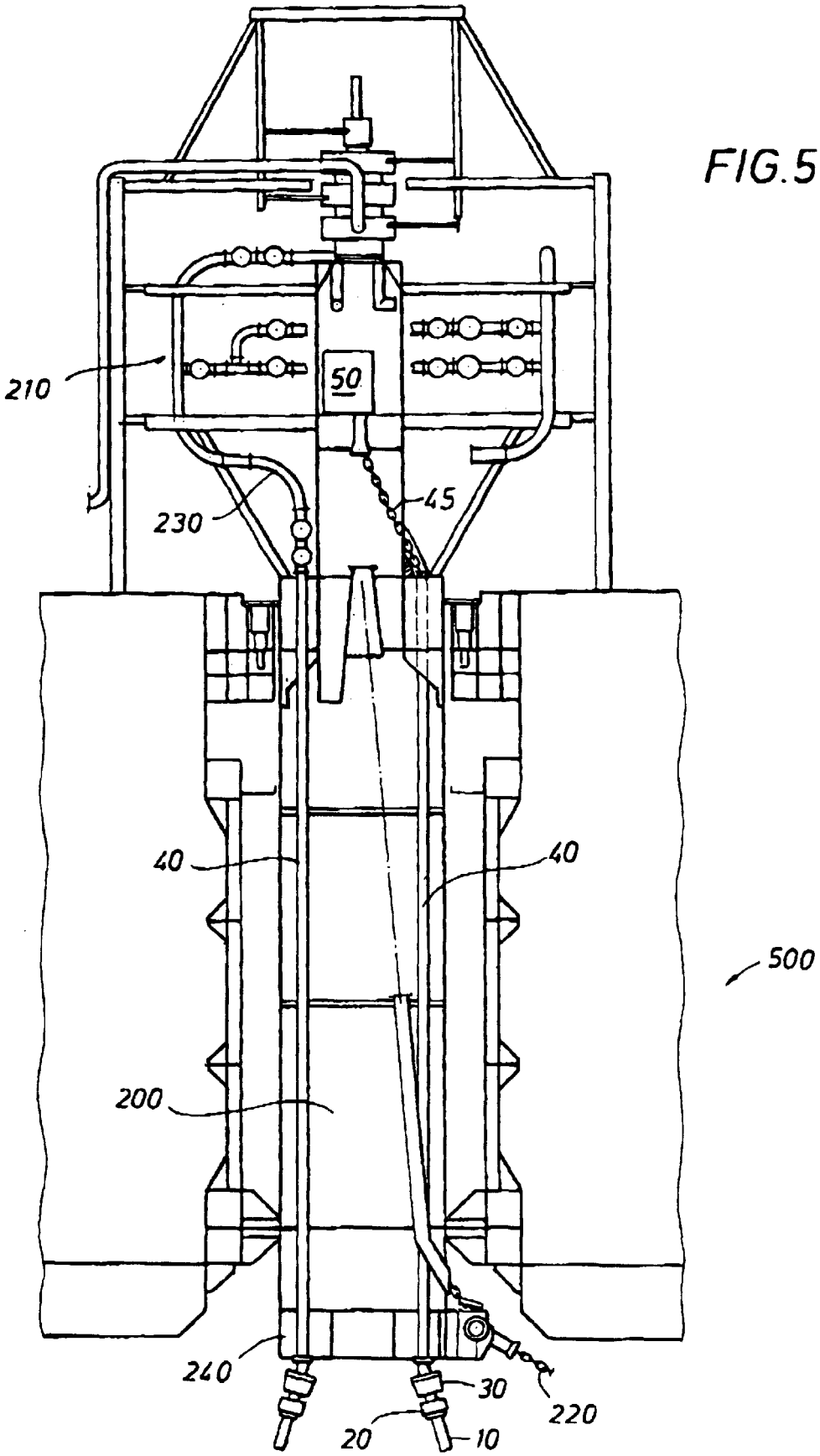
FIG. 5 illustrates a turret mooring arrangement according to the invention with an SCR riser secured to a bottom end of the turret and fluid coupling to production piping with a flexjoint providing limited flexibility at the connection of the riser to the flowline within the turret.
Figure 6:
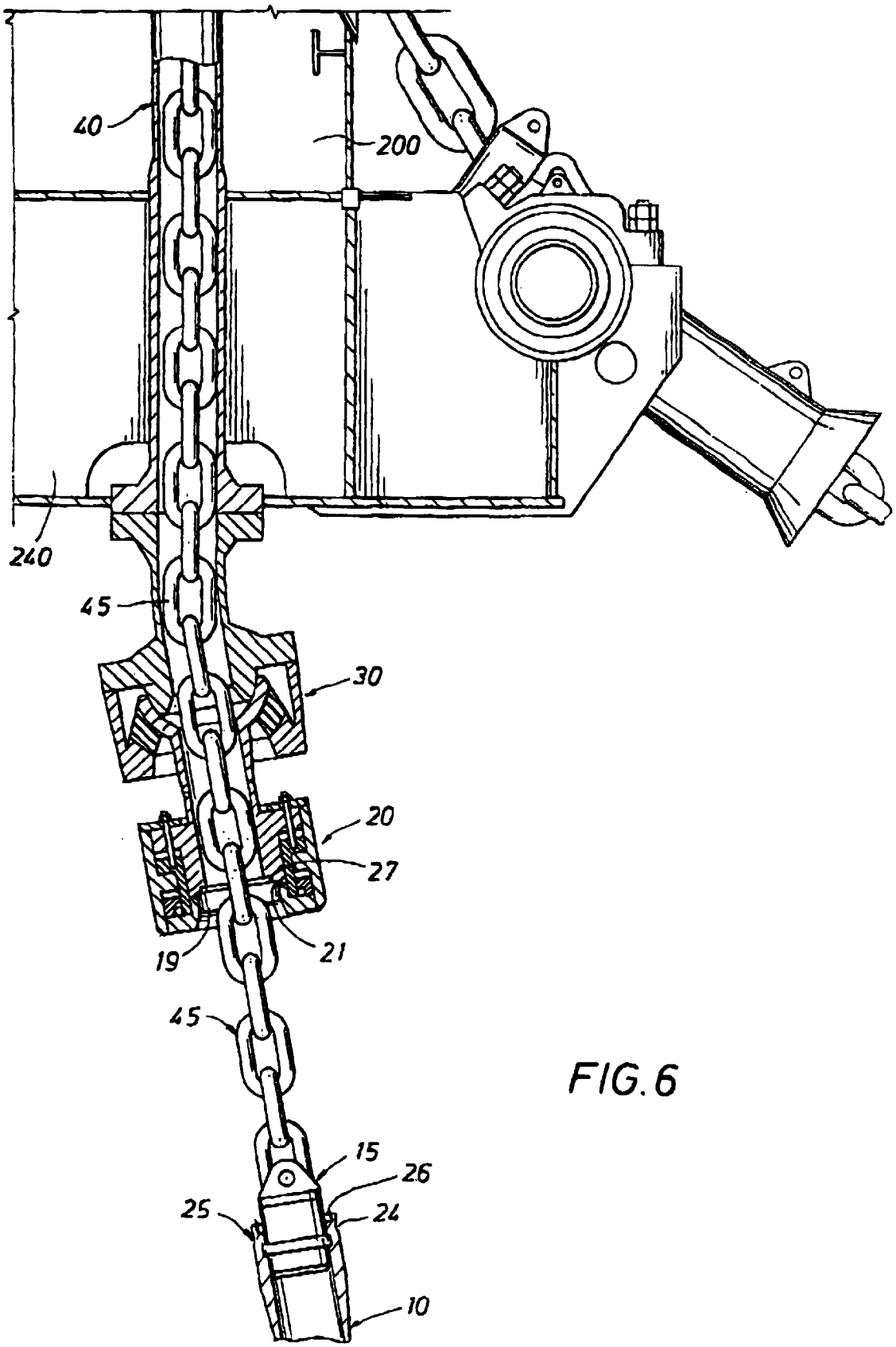
FIG. 6 is an enlarged illustration showing the riser being pulled up for fluid communication with a turret flowline by a pull-in line which runs through the flowline.
Figure 7:
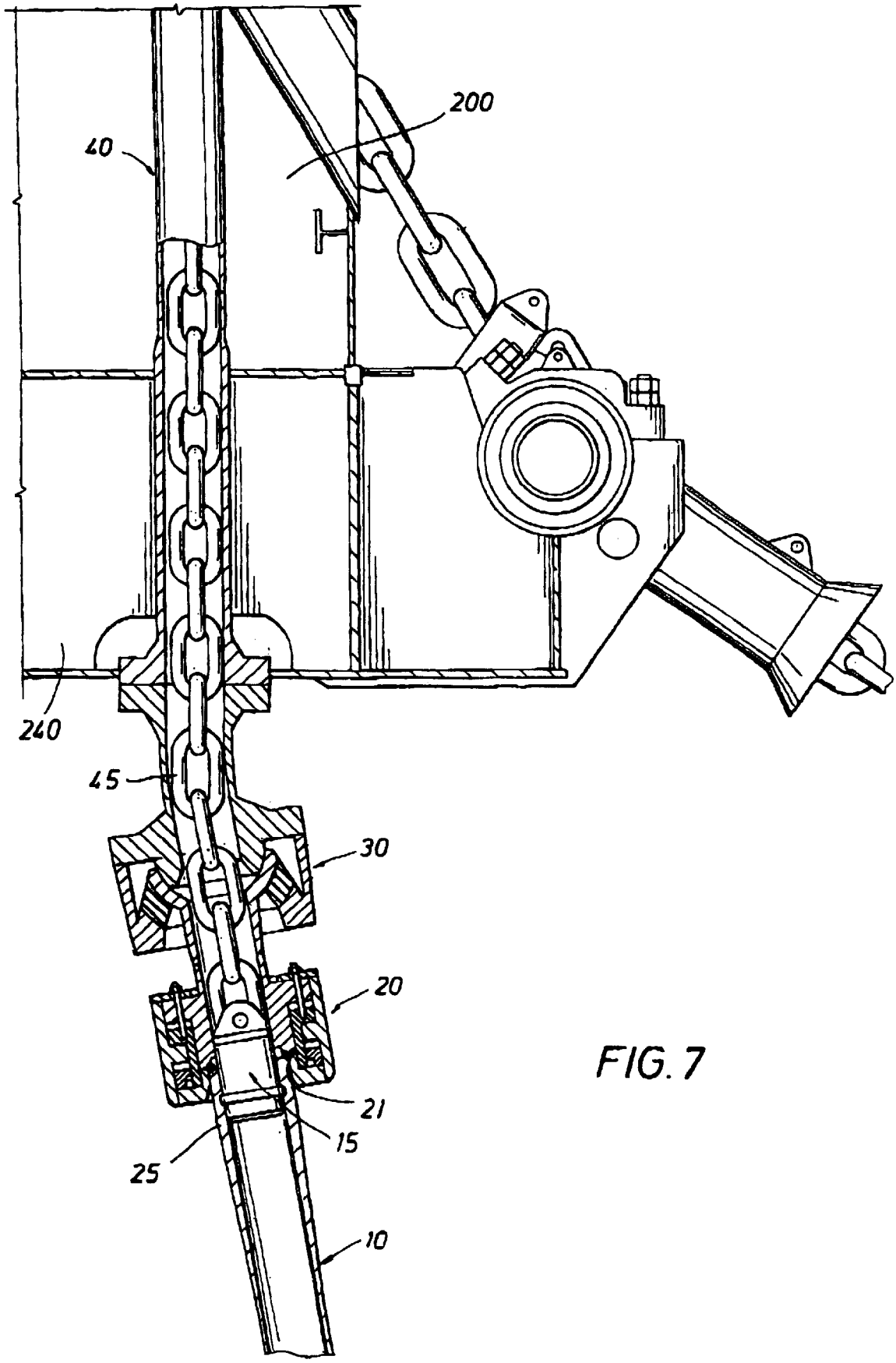
FIG. 7 is an enlarged illustration showing the riser connected by means of a connector and flex joint to a turret flowline with a pull-in line still attached thereto.

The arrangement of a flexjoint 30 with a connector 20 used to attach a riser 10 such as a SCR to a flowline 40 of a turret 200 of a FSO or FPSO is illustrated in FIGS. 5, 6 and 7. FIG. 5 illustrates a broad view of a turret mooring arrangement 500 in one embodiment of the invention where a riser 10 such as an SCR is secured at the bottom end of a chain table 240 with a flexjoint 30 providing limited flexibility at the connection of the riser 10 to the flowline 40 within the turret 200. The turret mooring arrangement 500 includes many components which are generally known in the art, including but not limited to the turret 200, anchor chains 220, chain table 240, and production equipment 210. Of particular relevance for this embodiment of the invention is a hoisting mechanism, such as winch 50, for "pulling in" the riser 10 by means of the pull-in line 45 through flowline 40 as seen in FIGS. 5, 6, and 7.

FIG. 6 is an enlarged illustration of FIG. 5 showing the details of the coupling of riser 10 to pull-in line 45 while being pulled into a connector 20. The pull-in line 45 passes through turret 200 and chain table 240 via flowline 40 to which a flexjoint 30 is secured at the lower end of the chain table 240. The flexjoint 30 can be one of many of those known in the art, including, but not limited to those described with reference to prior art arrangements above. A connector 20 fluidly and sealingly coupled to the flexjoint 30A is arranged and designed to receive a connector hub 25 (better seen in FIG. 13A), which is secured to the upper end of riser 10. Connector 20 and connector hub 25 cooperatively operate to connect riser 10 to connector 20 and to establish fluid-tight communication therebetween. Connector 20 (such as manufactured by FMC Technologies and known as the FMC TORUS™ connector) preferably includes actuators, which when activated and after hub 25 is pulled within opening 19 of connector 20, move the coupling members 21 radially inwardly into groove 24 of connector hub 25. The flexjoint 30 is placed above the connector 20 in order to provide alignment of the connector to the riser 10 during installation. Once connected, a fluid seal is established between seal 26 of hub 25 and shoulder 27 of connector 20 and flexjoint 30 thereafter provides flexible alignment of riser 10 with turret 200.

As illustrated in FIG. 6, the pull-in line 45 is lowered through flowline 40, flexjoint 30 and connector 20, and is connected to a pull-in head 15. The pull-in head 15 is releasably coupled within the upper end of connector hub 25 of the riser 10. The outer diameter of the pull-in head 15 is slightly smaller that the internal diameter of flowline 40, flexjoint 30 and connector 20, such that it can pass through the bore of those three devices (flowline 40, flexjoint 30, and connector 20). In operation, pull-in line 45 (with the pull-in head 15 attached) is lowered through flowline 40, flexjoint 30 and connector 20. The pull-in head is then releasably coupled to the connector hub 25 of the riser 10, and a hoist mechanism 50 or the like (see FIG. 5) is activated to "pull-in" the pull-in line 45, pull-in head 15, and riser 10 so that connector hub 25 of riser 10 is coupled within connector 20 as shown in FIG. 7. After the connector hub 25 is coupled within connector 20, the pull-in head 15 is released from riser 10 and pulled up together with the pull-in line 45 through the flowline 40. Further operational details are described below. The pull-in line 45 can be a tensioning member such as, a chain, wire rope, and the like.

In operation, once the riser 10 has been coupled to the connector 20, fluid communication can be established with production piping 230 (see FIG. 5), allowing the passage of fluid (such as hydrocarbons from a subsea well) and the like to and from a seabed 2 (FIG. 12).

The preferred method for installing the riser 10 is illustrated in FIGS. 8–17. FIGS. 8, 9, 10 and 11 illustrate conventional installation steps of the riser 10 by means of an installation vessel 100. FIG. 8 illustrates laying the flowline (riser) away from the position of a FPSO and shows a riser empty and without buoyancy. An acoustic positioning system is used for positioning using a long base line. FIG. 9 shows the next step prior to buoyancy modules being pre-installed on riser joints. FIG. 10 shows the riser 10 with buoyancy modules 11, and FIG. 11 illustrates continuation steps of adding pipe segments to the riser 10 and with a FSO or FPSO 300 brought into position near pipeline installation vessel 100. Tugs are provided (not shown) to hold the FSO or FPSO in lateral and rotational position.

FIGS. 12 and 13 show hand over of the riser 10 to the FSO/FPSO 300. The steps illustrated in FIGS. 12 and 13 include one method for installing the riser pull-in head (or connector hub 25) on the top of the riser 10 (see also FIG. 13A) and installing a clamp 70 and installation vessel winch line 66 on the riser. Hand over is completed by disconnecting winch line 66 from the riser by Remote Operated Vessel (ROV) or by other means.

FIGS. 13A, 14–17 illustrate final installation steps where a ROV is used to activate the hydraulic connector 20. FIG. 13A illustrates a preferred arrangement for connecting pull-in line 45 to riser 10 where the pull-in line 45 (with pull-in head 15 attached thereto) has been lowered (see also FIG. 6) through flowline 40, flexjoint 30, and connector 20. As mentioned above, the pull-in head 15 preferably is arranged and designed to pass through the bore of these devices (flowline 40, flexjoint 30, and connector 20). The pull-in head 15 is inserted within the upper end of riser 10 for releasable coupling. The riser 10/pull-in head 15 coupling is accomplished by a retainer 14 on pull-in head 15, which is arranged and designed to fit within a groove 26 inside of the upper end of riser 10 and within the connector hub 25. The retainer 14 on the pull-in head 15 is preferably a spring actuated coupler or similar device which is capable of being compressed when entering the female receptacle portion 9 of the riser 10 and then expanding when the coupler reaches the groove 26. Attached to an outer portion of the connector hub 26 is a head releaser 27, which when activated releases the pull-in head 15. For example, where the pull-in head 15 is a spring-actuated coupler 14, the coupler releaser 27 squeezes the spring coupler thereby releasing the pull-in head 15.

By reference to FIGS. 12 and 13, the riser 10 and pull-in head 15 can be coupled on a deck of a vessel 110 (FIG. 13) by pulling the pull-in line 45 and riser end 5 to a deck portion of vessel 100 for coupling. The releasably coupled riser 10/pull-in head 15 is then lowered back into the sea for the remaining operations.

FIG. 14 shows pull-in head 15 releasably coupled to the riser 10 at its upper end. After coupling is made, a hoist mechanism (FIG. 5) or the like pulls in the pull-in line 45, pull-in head 15, and riser 10. As described above this "pull-in" is accomplished through the flowline 40 through which the pull-in line 45 and pull-in head 15 were lowered. The "pull-in" helps engage connector hub 25 of riser 10 within connector 20. The flexjoint 30, as described above, helps provide alignment of the connector 20 to the riser 10 during installation. The connector hub 25 is prevented from entering an upper portion of the connector and the flexjoint because (1) engagement with the parts of the connector 20 is arranged and designed to receive the connector hub 25 and (2) the connector hub 25 has a larger diameter than the bore diameters of connector 20, flexjoint 30, and flowline 40.

FIG. 15 shows connector hub 25 of riser 10 engaged with connector 20. Upon engagement, ROV 110 hydraulically activates the connector 20 (as described above with reference to FIGS. 6 and 7) on the connector 20. The activation of the actuators can include engagement of pins or rods 21 into the groove 24 (described, by reference to FIG. 6). Such actuation can include spring actuation, hydraulic actuation, and the like. Actuation of pins 21 into groove 24 couples the connecter 20 to hub 25 and establishes sealing contact between seal 21 and surface 27.

FIG. 16 shows the complete coupling of hub 25 of riser 10 and connector 20. After such coupling, ROV 1000 engages the head releaser 27 (described with reference to FIG. 13A) on the connector hub 25 for releasing the pull-in head 15. As mentioned above, such release can include the compression of spring actuators or the like for the release of retainer 14 on pull-in head 15 from groove 26 in connector hub 25.

After the release of pull-in head 15, the pull-in line 45 and pull-in head 15 are pulled through flowline 40 via a hoisting mechanism 40 (FIG. 5) or the like and removed from the flowline 40. Then, if desired, fluid communication between the riser 10 and production piping 230 can be hydrotested.

FIG. 17 shows the completion of the coupling of the riser 10 and turret mooring arrangement 500. Upon completion, winch line 66 can be removed via a ROV 1000.

It should be understood that the invention is not limited to the exact details of construction, operation, or embodiments shown and described, because certain modifications and equivalents will be apparent to one skilled in the art. The invention is accordingly limited only by the scope of the claims.

What is claimed is:

1. A method for connecting a riser (10) and a flowline (40) of a turret (200) of a vessel floating on a sea surface, said vessel including a flowline connector (20) fluidly coupled to a lower end of said flowline (40), comprising the steps of:

positioning said riser (10) in the sea with a lower end of the riser (10) laid on said seabed and with an upper end of the riser (10) in proximity to said turret of said vessel, extending a tension member (45) from a hoisting mechanism (50) on said vessel from an upper end of said flowline (40) and through said flowline (40) and said flowline connector (20), said tension member (45) having a pull-in head (15) secured to a lower end thereof and sized with respect to a minimum inner diameter of said flowline (40) and said flowline connector (20) to permit said pull-in head (15) to translate through said flowline (40) and said flowline connector (20), removably securing said pull-in head (15) to said upper end of said riser (10), pulling said tension member (45) up through said flowline (40) and said flowline connector (20) with said hoisting mechanism (50) until said upper end of said riser (10) is fluidly connected to said flowline connector (20), removing said pull-in head (15) from securement with said upper end of said riser (10), and pulling said tension member (45) and said pull-in head (15) up through said flowline connector (20) and said flowline (40) with said hoisting mechanism (50) until said tension member (45) is removed from said flowline (40), whereby, fluid connection is established between said riser (10) and said flowline (40) through said flowline connector (20).

2. The method of claim 1 further comprising the step of fluidly coupling a flex joint (30) between said lower end of said flowline (40) and said flowline connector (20), said flexjoint (30) having an internal flow passage sized to permit said pull-in head (15) to translate therethrough, said flex joint providing angled fluid coupling of said flowline connector (20) with said lower end of said flowline (40).

3. The method of claim 1 wherein said upper end of said riser includes a hub (25) which is arranged and designed for removable connection to said pull-in head (15) and for fluid coupling and securement with said flowline connector (20), said method including the sub-steps of:

latching said pull-in head (15) into a female opening of said hub (25), pulling said pull-in head (15) and said hub (25) up into a female opening of said flowline connector (20) until said hub (25) is secured within said flowline connector (20), and then, unlatching said pull-in head (15) from said hub (25) and pulling said pull-in head (15) and said tension member (45) from said flowline (40).

4. The method of claim 3 wherein said pull-in head (15) includes a spring actuatable retainer (14) designed and arranged to expand into a groove (26) in said female opening of said hub (25) and said hub (25) includes our exteriorly mounted coupler releasing mechanism (27) on said hub (25) which is arranged and designed for manipulating said coupler (14) for disconnecting said pull-in head (15) from said coupler (14), and further including the substep of:

squeezing said releasing mechanism (27) with an ROV (1000) arm to disconnect said pull-in head (15) from said hub (25).

5. The method of claim 4 wherein;

said hub (25) includes at least one exterior groove (24) which is arranged and designed for alignment with coupling members (21) within said female opening of said flowline connector (20), where said hub (25) is pulled up into said flowline connector (20) by said tension member (45), and further including the substep of:

actuating said members (21) into said groove (24) of said hub (25) to secure said hub (25) to said connector (20) for fluid coupling there between.

6. An arrangement for connecting a riser (10) between a seabed and a flowline (40) of a turret (200) of a vessel floating on a sea surface, comprising;

a flowline connector (20) fluidly coupled to a lower end of said flowline (40), a hoisting mechanism (50) mounted on said vessel, a tension member (45) extending from said hoisting mechanism (50) through said flowline (40) and said flowline connector (20), said tension member (45) having a pull-in head (15) secured to a lower end thereof and sized with respect to a minimum inner diameter of said flowline (40) and said flowline connector (20) to permit said pull-in head (15) to pass through said flowline (40) and said flowline connector (20), means for removably securing the pull-in head (15) to an upper end of said riser (10), and means for establishing a fluid coupling between said upper end of said riser and said flowline connector (20) after said hoisting mechanism (50) pulls in said tension member (45) and said pull-in head (15) into said flowline connector (20).

7. The arrangement of claim 6 further comprising;

a flexjoint (30) fluidly coupled between said lower end of said flowline (40) and said flowline connector (20), said flex joint (30) having an internal flow passage sized to permit said pull-in head (15) to pass therethrough, said flex joint providing angled fluid coupling of said flowline connector (20) with said lower end of said flowline (40).

8. The arrangement of claim 6 wherein;

said upper end of said riser (10) includes a hub (25) which is arranged and designed for removable connection to said pull-in head (15) and for fluid coupling and securement within a female opening of said flowline connector (20).

9. The arrangement of claim 8 wherein;

said pull-in head (15) includes a spring actuated retainer (14) which is designed and arranged to expand into a groove (26) of a female opening (9) of said hub (25), and said hub (25) includes an exteriorly mounted coupler releasing mechanism (27) on said hub (25) which is arranged and designed for manipulating said coupler (14) for disconnecting said pull-in head (15) from said coupler (14).

10. The arrangement of claim 9 wherein;

said hub (25) includes an exterior groove (24) which is arranged and designed for alignment with connector members (21) within said female opening of said flowline connector (20) when said hub (25) is pulled up into said flowline connector (20) by said tension member (45).

* * * * *